US011872630B2

(12) United States Patent
Mueller et al.

(10) Patent No.: US 11,872,630 B2
(45) Date of Patent: Jan. 16, 2024

(54) METHOD FOR PRODUCING A CAMSHAFT ADJUSTER

(71) Applicant: Miba Sinter Austria GmbH, Laakirchen (AT)

(72) Inventors: Alexander Mueller, Altmuenster (AT); Karl Dickinger, Vorchdorf (AT); Wolfgang Siessl, Traunkirchen (AT)

(73) Assignee: Miba Sinter Austria Gmbh, Laakirchen (AT)

( * ) Notice: Subject to any disclaimer, the term of this patent is extended or adjusted under 35 U.S.C. 154(b) by 289 days.

(21) Appl. No.: 17/145,525

(22) Filed: Jan. 11, 2021

(65) Prior Publication Data

US 2021/0246813 A1 Aug. 12, 2021

(30) Foreign Application Priority Data

Feb. 7, 2020 (AT) ..... A 50093/2020

(51) Int. Cl.
*B22F 5/08* (2006.01)
*F01L 1/344* (2006.01)
(Continued)

(52) U.S. Cl.
CPC ..... *B22F 5/08* (2013.01); *B22F 3/10* (2013.01); *B22F 3/162* (2013.01); *B22F 5/00* (2013.01);
(Continued)

(58) Field of Classification Search
CPC ..... B22F 3/10; B22F 3/12; B22F 3/16; B22F 3/162; B22F 3/24; B22F 5/00; B22F 5/008; B22F 5/08; B22F 5/085; B22F 2003/245; B22F 2003/247; B22F 2003/248; F01L 1/02; F01L 1/026; F01L 1/04;
(Continued)

(56) References Cited

U.S. PATENT DOCUMENTS 6,474,280 B2 11/2002 Maeyama et al.
6,910,451 B2 6/2005 Maeyama et al.
(Continued)

FOREIGN PATENT DOCUMENTS

AT 519 135 A1 4/2018
DE 10 2008 035 935 A1 2/2010
(Continued)

*Primary Examiner* — Sally A Merkling
*Assistant Examiner* — Dean Mazzola
(74) *Attorney, Agent, or Firm* — Collard & Roe, P.C.

(57) ABSTRACT

A method without a calibration step produces a camshaft adjuster including a stator, a rotor rotatable relative thereto and a control valve, wherein the rotor and/or the stator is or are produced according to a powder-metallurgical process, wherein the stator in the region of a fitting surface for contacting the camshaft and/or the rotor in the region of a fitting surface for contacting the camshaft and/or in the region of a fitting surface for contacting the control valve and/or the control valve in the region of a sealing surface is or are produced having a tolerance so that a clearance fit with a maximum clearance of 100 μm is formed between the fitting surface for the camshaft and the camshaft and/or between the fitting surface for contacting the sealing surface of the control valve and the sealing surface of the control valve.

7 Claims, 6 Drawing Sheets

(51) Int. Cl.

| | |
|---|---|
| ***F01L 1/047*** | (2006.01) |
| ***B22F 3/16*** | (2006.01) |
| ***B22F 5/00*** | (2006.01) |
| ***B22F 3/10*** | (2006.01) |

(52) U.S. Cl.
CPC ..... *F01L 1/047* (2013.01); *F01L 1/3442* (2013.01); *B22F 2998/10* (2013.01); *F01L 2001/34426* (2013.01); *F01L 2303/00* (2020.05)

(58) Field of Classification Search
CPC . F01L 1/047; F01L 1/08; F01L 1/3442; F01L 2001/34426; F01L 2303/00
See application file for complete search history.

(56) References Cited

U.S. PATENT DOCUMENTS

| | | | |
|---|---|---|---|
| 8,636,264 | B2 | 1/2014 | Donaldson et al. |
| 9,435,381 | B2 | 9/2016 | Larson |
| 10,094,251 | B2 | 10/2018 | Weber |
| 10,413,967 | B2 | 9/2019 | Tausend et al. |
| 10,584,617 | B2 | 3/2020 | Weber |
| 10,704,430 | B2 | 7/2020 | Bohner et al. |
| 2011/0185995 | A1 | 8/2011 | Deblaize et al. |
| 2014/0026835 | A1 | 1/2014 | Boese et al. |
| 2015/0084727 | A1 | 3/2015 | Ozeki et al. |
| 2016/0245315 | A1 | 8/2016 | Wallace |
| 2018/0080538 | A1 | 3/2018 | Gebhart et al. |
| 2019/0162084 | A1* | 5/2019 | Bohner ..... F01L 1/3442 |
| 2020/0095905 | A1 | 3/2020 | Casellas et al. |

FOREIGN PATENT DOCUMENTS

| | | | |
|---|---|---|---|
| DE | 10 2012 222 271 | A1 | 6/2014 |
| DE | 10 2013 015 677 | A1 | 3/2015 |
| DE | 10 2013 226 445 | A1 | 6/2015 |
| DE | 10 2016 125 659 | A1 | 6/2018 |
| DE | 10 2017 111 110 | A1 | 11/2018 |
| DE | 10 2017 011 004 | A1 | 5/2019 |
| DE | 10 2017 127 676 | A1 | 5/2019 |
| DE | 10 2018 101 979 | A1 | 8/2019 |
| EP | 1 400 660 | A1 | 3/2004 |
| EP | 2824343 | A2 | 1/2015 |
| JP | H02-150541 | A | 6/1990 |
| JP | H10-19552 | A | 1/1998 |
| JP | 2002-070512 | A | 3/2002 |
| WO | 2008-157340 | A2 | 12/2008 |

* cited by examiner

METHOD FOR PRODUCING A CAMSHAFT ADJUSTER

CROSS REFERENCE TO RELATED APPLICATIONS

Applicant claims priority under 35 U.S.C. § 119 of Austrian Application No. A50093/2020 filed Feb. 7, 2020, the disclosure of which is incorporated by reference.

BACKGROUND OF THE INVENTION

1. Field of the Invention

The invention relates to a method without a calibration step for producing a hydraulic camshaft adjuster, comprising a stator with a stator base body, which is produced with an external spur gearing, a radially internal lateral surface and with webs protruding radially inwards from the radially internal lateral surface, which webs are distanced from one another in the circumferential direction of the stator base body, and wherein the stator base body is possibly produced with a fitting surface for contacting a camshaft;

a rotor being rotatable relative to the stator and having a rotor base body, which is at least partially surrounded by the stator and which is produced with blades protruding radially outwards from a radially external lateral surface, so that multiple hydraulic working spaces are formed between the stator and the rotor, each of which working spaces being subdivided into a first working chamber and a second working chamber by a blade of the rotor;

a control valve which is preferably arranged so as to be at least partially surrounded by the rotor;

wherein the control valve is produced having a sealing surface on an external lateral surface;

wherein the rotor base body is preferably produced with a recess for the control valve, and the recess is produced with a fitting surface for the sealing surface;

and wherein the rotor base body is further produced with a fitting surface for contacting the camshaft;

and wherein the rotor and/or the stator is or are produced according to a powder-metallurgical process, further comprising the method steps of:

providing a first powder for producing the rotor;

pressing the first powder to form a rotor green compact;

possibly green machining the rotor green compact;

sintering the rotor green compact;

possibly post-processing the rotor green compact by means of material removal;

and/or comprising the method steps:

providing a second powder for producing the stator (6);

pressing the second powder to form a stator green compact;

possibly green machining the stator green compact;

sintering the stator green compact;

possibly post-processing the stator (6) by means of material removal;

possibly hardening the spur gearing (4) of the stator (6).

The invention further relates to a hydraulic camshaft adjuster for variably adjusting the engine valve timing of gas exchange valves of an internal-combustion engine, comprising:

a stator, particularly comprising a sintering material or consisting thereof, with a stator base body, which stator has an external spur gearing, a radially internal lateral surface and webs protruding radially inwards from the radially internal lateral surface, which webs are distanced from one another in the circumferential direction of the stator base body, and wherein the stator base body possibly has a fitting surface for contacting a camshaft;

a rotor, particularly comprising a sintering material or consisting thereof, being rotatable relative to the stator and having a rotor base body, which is at least partially surrounded by the stator and which has blades protruding radially outwards from a radially external lateral surface, so that multiple hydraulic working spaces are formed between the stator and the rotor, each of which working spaces being subdivided into a first working chamber and a second working chamber by a blade of the rotor;

a control valve which is preferably at least partially surrounded by the rotor;

wherein the control valve has a sealing surface on an external lateral surface;

wherein the rotor base body preferably has a recess for the control valve, and the recess has a fitting surface for the sealing surface;

and wherein the rotor base body further has a fitting surface for contacting the camshaft.

The invention further relates to a single-piece stator for a camshaft adjuster made of a sintering material, comprising a stator base body, which has an external spur gearing, a radially internal lateral surface and webs protruding radially inwards from the radially internal lateral surface, which webs are distanced from one another in the circumferential direction of the stator base body.

In addition, the invention relates to a single-piece rotor for a camshaft adjuster made of a sintering material, comprising a rotor base body, which has blades protruding radially outwards from a radially external lateral surface.

The invention also relates to a control valve for a camshaft adjuster comprising a control valve base body which has a sealing surface on an external lateral surface.

2. Description of the Related Art

Camshaft adjusters are known to serve for adjusting the valve opening times in order to thus achieve a higher efficiency of a combustion engine. Various embodiments of them are known from the prior art. A generic hydraulic camshaft adjuster comprises a stator, in which a rotor is arranged. The rotor is connected to the camshaft so as to rotate with it. The stator, which is connected to the crankshaft, has webs protruding radially inwards, which webs form the stop faces for the blades of the rotor. Thus, the rotor can only by rotated by a predefined angle range relative to the stator.

In this context, it is also known to powder-metallurgically produce at least parts of a camshaft adjuster from sintering materials. For example, DE 10 2013 226 445 A1 describes a camshaft adjuster for an internal combustion engine of the vane cell type, having a stator and a rotor which can be rotated relative to the stator and consists of a plurality of rotor parts which are connected to one another, wherein the rotor can be connected fixedly to a camshaft of the internal combustion engine so as to rotate with it, and a first rotor part is configured in such a way that the camshaft is supported with contact on the first rotor part in an operating state, wherein the first rotor part is produced by means of a sintering process, and at least one first supporting surface, supporting the camshaft, of the first rotor part is set geometrically by means of a non-cutting processing operation.

DE 10 2013 015 677 A1 describes a method for producing a sintered part with high radial precision, wherein the sintered part is produced from at least a first sintered adherend and a second sintered adherend, and wherein the method comprises at least the following steps: joining the first sintered adherend to the second sintered adherend, causing the high radial precision, having a deformation of at least one radial deformation element, which is preferably positioned so as to adjoin a joining contact zone, wherein deforming the radial deformation element is effected at least by a calibration tool and is carried out substantially as a plastic deformation of the radial deformation element.

DE 10 2018 101 979 A1 describes a hydraulic camshaft adjuster for variably adjusting the engine valve timing of gas exchange valves of an internal combustion engine with a stator and a rotor that is rotatable relative to the stator, wherein webs protruding radially inwards are formed on the stator, wherein blades protruding radially outwards are formed on the rotor, wherein multiple hydraulic working spaces are formed between the stator and the rotor, each of which working spaces being subdivided into a first working chamber and a second working chamber by a blade of the rotor, and wherein the stator comprises a first stator component and a second stator component, which are arranged concentrically about a common axis of rotation, wherein a first stop for a blade of the rotor is formed on the first stator component, wherein a second stop for a blade of the rotor is formed on the second stator component, and wherein the adjustment range of the rotor is defined by the positioning of the two stator components relative to each other.

SUMMARY OF THE INVENTION

The underlying object of the present invention is to simplify the production of a hydraulic camshaft adjuster.

The object is achieved by the initially mentioned method, according to which it is provided that the stator in the region of the fitting surface of the stator base body for contacting the camshaft and/or the rotor in the region of the fitting surface of the rotor base body for contacting the camshaft and/or in the region of the fitting surface for contacting the sealing surface of the control valve and/or the control valve in the region of the sealing surface is or are produced with a tolerance, that a clearance fit with a maximum clearance of 100 μm or a press fit is formed between the fitting surface for the camshaft and the camshaft and/or between the fitting surface for contacting the sealing surface of the control valve and said sealing surface of the control valve.

The object in the case of the initially mentioned hydraulic camshaft adjuster is further achieved in that the stator has a tolerance in the region of the fitting surface of the stator base body for contacting the camshaft and/or the rotor in the region of the fitting surface of the rotor base body for contacting the camshaft and/or in the region of the fitting surface for contacting the sealing surface of the control valve and/or the control valve in the region of the sealing surface, that a clearance fit with a maximum clearance of 100 μm or a press fit is formed between the fitting surface for the camshaft and the camshaft and/or between the fitting surface for contacting the sealing surface of the control valve and said sealing surface of the control valve.

In addition, the object of the invention is achieved by means of the initially mentioned stator, the initially mentioned rotor and/or the initially mentioned control valve, in which it is provided that a tolerance is formed in the region of a fitting surface of the stator base body for contacting a camshaft, that a clearance fit with a maximum clearance of 100 μm, in particular with a maximum clearance of 80 μm, for example a clearance between 5 μm and 60 μm or between 5 μm and 50 μm, or a press fit is formed between the fitting surface for the camshaft and the camshaft, and/or that a region of the fitting surface of the rotor base body for contacting a camshaft and/or a region of a fitting surface for contacting a sealing surface of a control valve has a tolerance, that a clearance fit with maximum clearance of 100 μm, in particular with a maximum clearance of 80 μm, preferably with a clearance between 5 μm and 60 μm, is formed between the fitting surface for the camshaft and the camshaft and/or between the fitting surface for contacting the sealing surface of the control valve, and/or that a region of the sealing surface has a tolerance, that a clearance fit with a maximum clearance of 100 μm, in particular with a maximum clearance of 80 μm, preferably a clearance between 5 μm and 60 μm, or a press fit is formed between a fitting surface of a rotor for contacting the sealing surface of the control valve and said sealing surface of the control valve.

In this regard, it is advantageous that by reducing the tolerance in the region of the fitting surfaces and/or the at least one sealing surface, the respective component can be produced in principle without loss of properties such as coaxiality, concentricity, axial runout etc. and with a higher tolerance. In other words, the tolerance gain can be transferred to another region of the assembly. This allows shortening the approach that has been common in the sintering process by the calibration step. During calibration, the sintered component is subjected to a high pressure in a calibration die, so that component inaccuracies can be weakened and/or eliminated due to the precision of the calibration die. This does not only require time and energy, but the flashes that have possibly occurred must subsequently be removed. Saving said method step of "calibration" thus allows realizing corresponding advantages both with respect to resource utilization and with respect to production cost of the components.

In order to further amplify the aforementioned effects, it may be provided according to an embodiment variant of the invention that the stator is configured as a sintered component, as well. To this end, according to an embodiment variant of the method, it may comprise the further method steps:

- providing a second powder for producing the stator;
- pressing the second powder to form a stator green compact;
- possibly green machining the stator green compact;
- sintering the stator green compact;
- possibly post-processing the stator by means of material removal;
- possibly hardening the spur gearing of the stator.

According to a further, preferred embodiment variant it may also be provided in this regard that the stator is also produced without a calibration step, which allows achieving the previously mentioned advantages also in the production of the stator.

According to another embodiment variant of the invention, it may be provided that for forming the press fit or press fits on at least one of the fitting surfaces and/or the sealing surface, at least one projection protruding in the radial direction and/or the axial direction is formed, which projection is pressed, for forming the press fit, with the respective other surface of the surfaces forming the press fit. Thereby, the excess provided for the press fit can be produced easily, in particular if the rotor and/or the stator are formed as sintered components. By plasticizing the at least one projection during the installation of the gear, the intended tolerance shift from a component of the camshaft adjuster to a different component thereof can be achieved relatively easily. Thus, the previously addressed nominal size of the joint clearance that is normally used for installing the camshaft adjuster may be used, for example for improving the concentricity of the toothing of the stator.

According to a different embodiment variant of the invention, it may be provided that the at least one projection is designed to be at least approximately strip-shaped, whereby assembling the camshaft adjuster and/or arranging the rotor on the camshaft can be simplified.

In this regard, another embodiment variant of the invention may provide that the at least one projection has an at least approximately trapezoidal or triangular cross-section for amplifying the aforementioned effect. This allows achieving a geometry of the at least one projection that tapers in the direction toward the counter-fitting surface, whereby the plastic deformation may be facilitated.

For further simplifying the assembly of the camshaft adjuster or the arrangement of the rotor on the camshaft adjuster, it may also be provided according to a further embodiment variant that the at least one projection is designed to have a height increasing over the course the longitudinal extension.

For further improving the mentioned effects, it may preferably be provided according to another embodiment variant of the invention that the projection or the projections are produced having a maximum height which is selected from a range between 0.1 mm and 3 mm, in particular from a range between 0.1 mm and 0.5 mm.

According to a further embodiment variant of the invention, it may be provided that the projection on the sealing surface of the control valve is designed annularly. With this embodiment variant, the leakproofness of the control valve seat can be achieved easily, whereby the provided tolerance in this region may be further reduced.

For achieving this effect more easily, an embodiment variant of the invention may provide that the projection on the sealing surface of the control valve is produced in a powder-metallurgical manner and/or consists of a sintering material. The above-mentioned plasticization can thus be carried out more easily due to the porosity of sintering materials.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

First of all, it is to be noted that in the different embodiments described, equal parts are provided with equal reference numbers and/or equal component designations, where the disclosures contained in the entire description may be analogously transferred to equal parts with equal reference numbers and/or equal component designations. Moreover, the specifications of location, such as at the top, at the bottom, at the side, chosen in the description refer to the directly described and depicted figure and in case of a change of position, these specifications of location are to be analogously transferred to the new position.

Figure 1:
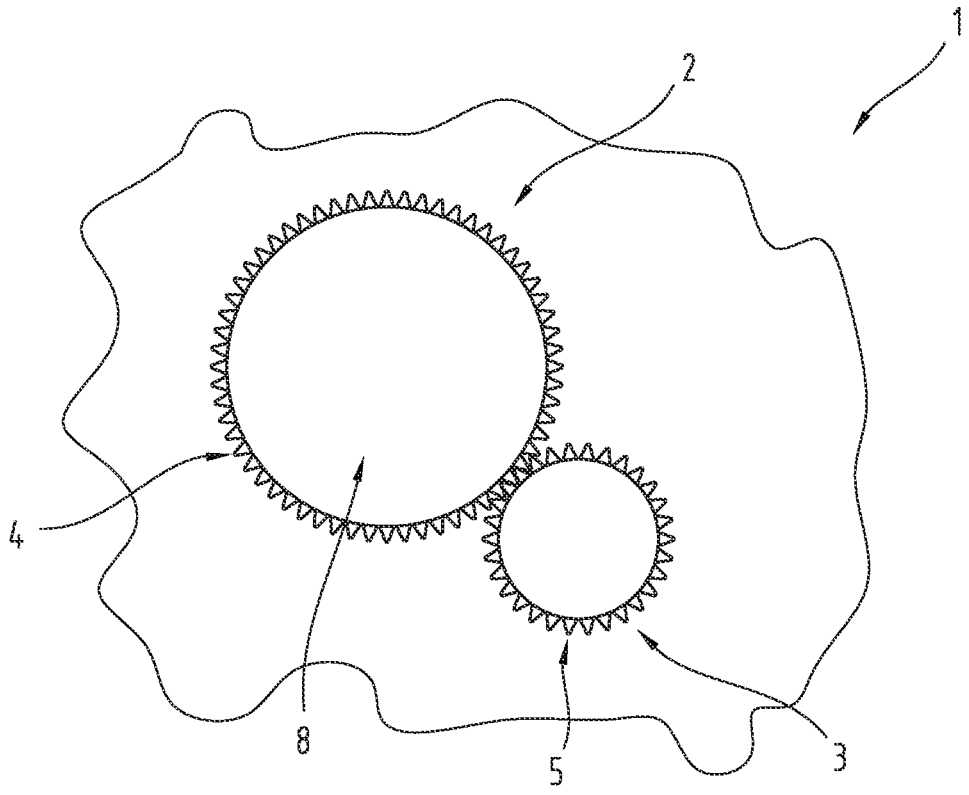
FIG. 1 shows a cutout from a combustion engine.

FIG. 1 shows a cutout from a combustion engines 1. A hydraulic camshaft adjuster 2 and a drive wheel 3 are shown. The camshaft adjuster 2 has a spur gearing 4 on its outer circumference. The drive wheel 3 also has a spur gearing 5 on its outer circumference. The two spur gearings 4, 5 are arranged in a meshing engagement with one another.

The spur gearing 4 of the camshaft adjuster 2 can also be configured for engaging with a timing chain (not shown).

In principle, this configuration of hydraulic camshaft adjusters 2 is known from the prior art, so that further explanations regarding this can be dispensed with.

Figure 2:
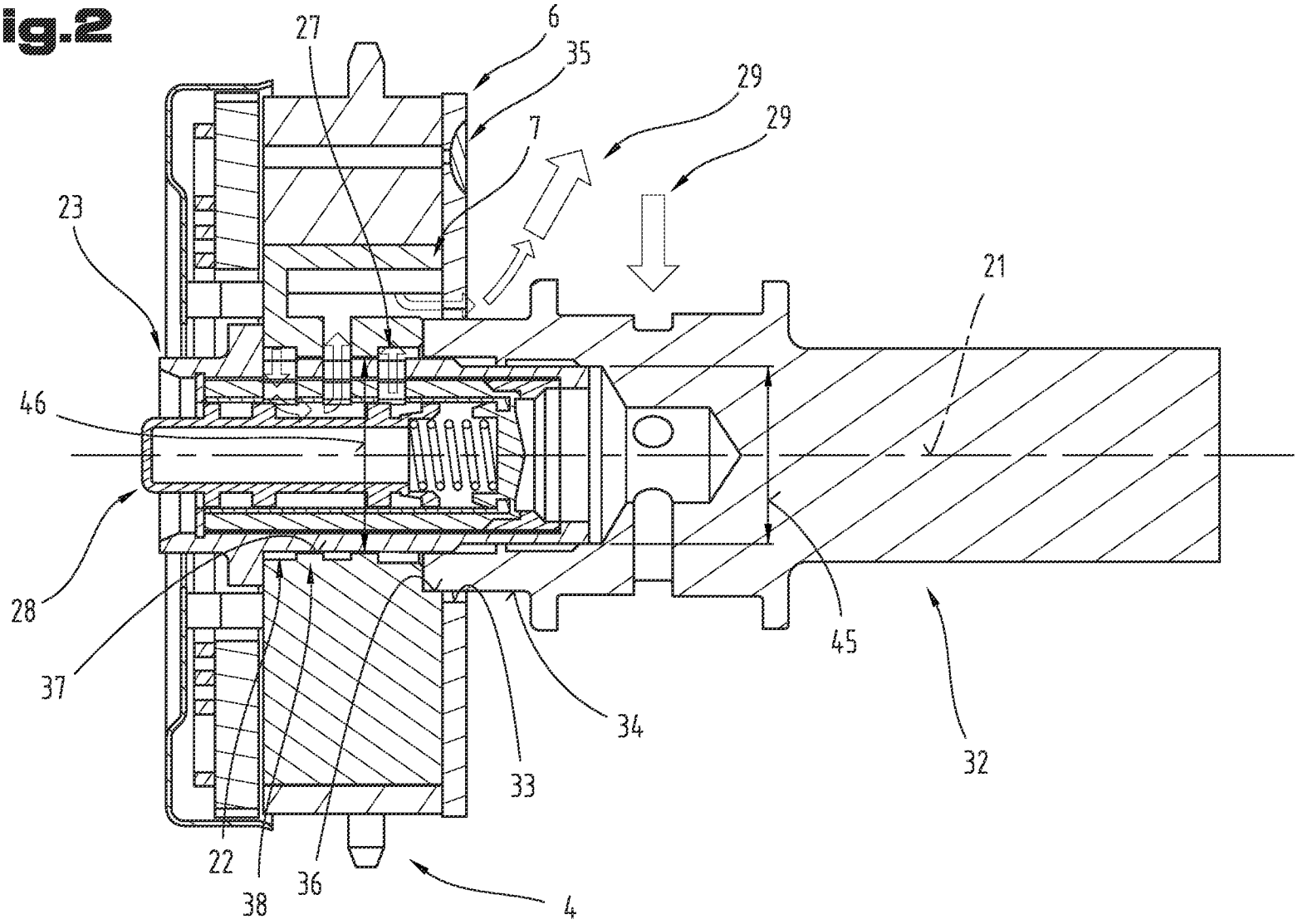
FIG. 2 shows a cutout from a hydraulic camshaft adjuster in a longitudinal section.
Figure 3:
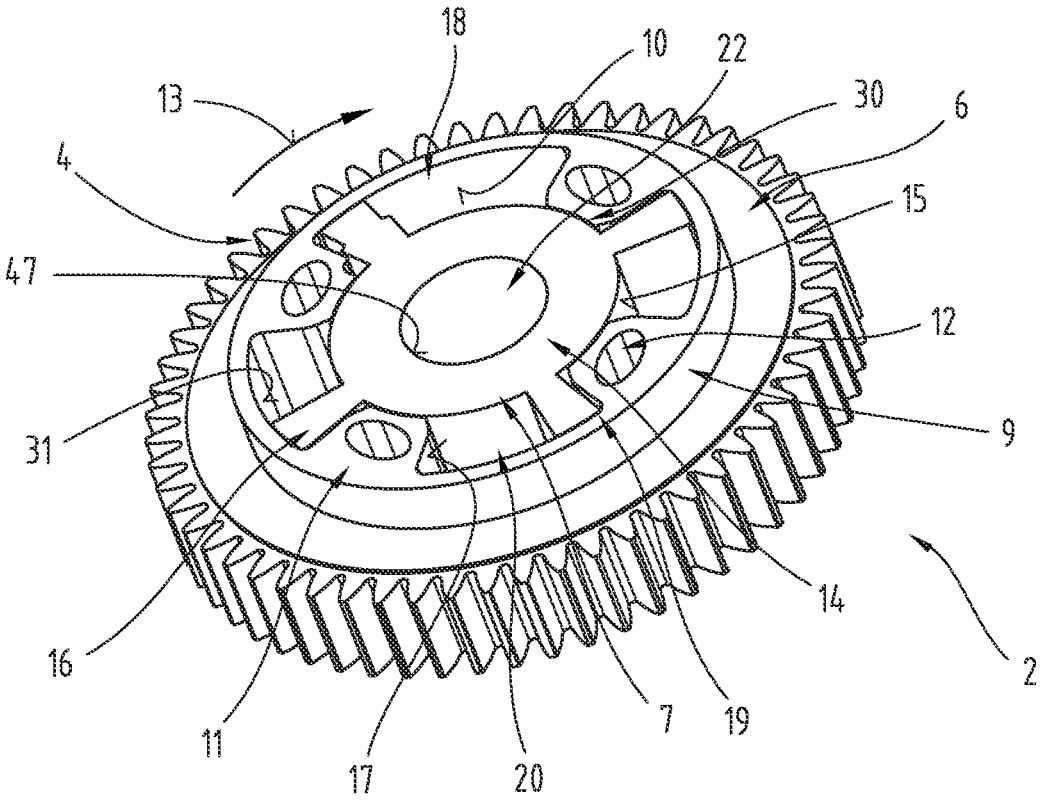
FIG. 3 shows the stator and the rotor of the camshaft adjuster according to FIG. 2 in an oblique view.
Figure 4:
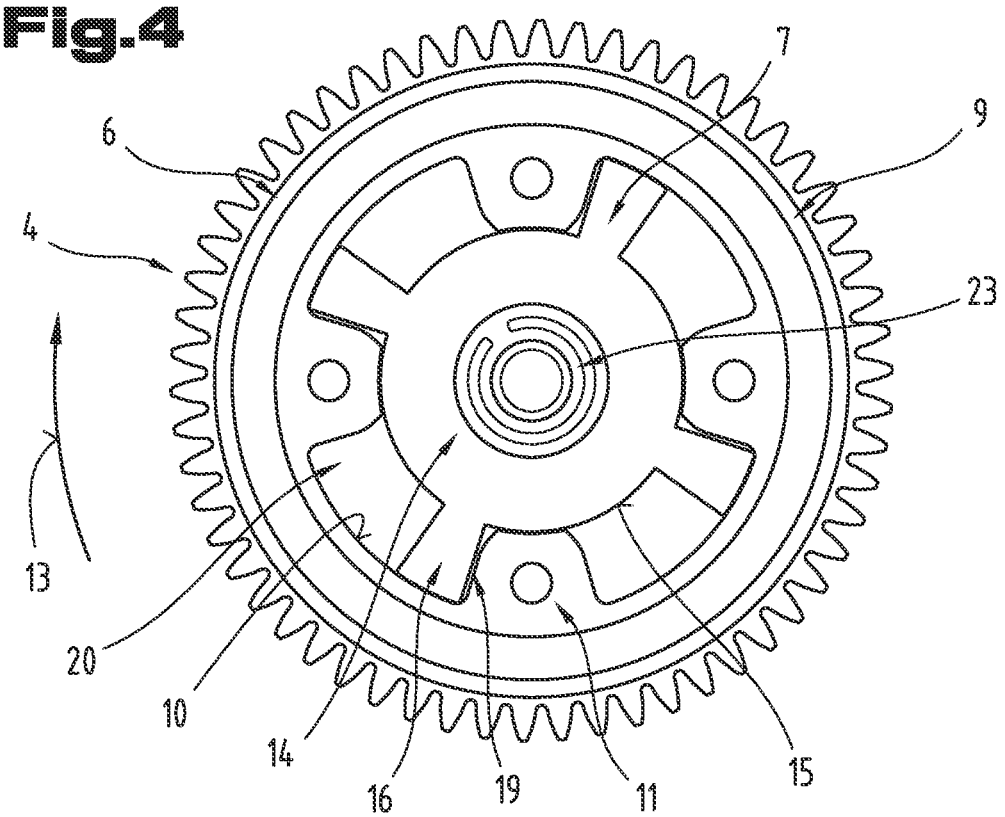
FIG. 4 shows the stator and the rotor of the camshaft adjuster according to FIG. 2 in a front view.

As can be seen in FIGS. 2 to 4, the camshaft adjuster 2 has a stator 6 and a rotor 7. The representation of a covering 8 on the front side of the camshaft adjuster 2 that can be seen in FIG. 1 was dispensed with in FIGS. 3 and 4.

The stator 6 has an annular stator base body 9, which has the external toothing in the form of the spur gearing 4 on its outer circumference—as previously mentioned. Webs 11 are formed on a radially internal lateral surface 10 of the stator base body 9 so as to protrude radially inwards beyond said lateral surface 10. In the particular case, the stator 6 has four webs 11. This number of webs 11, however, is not to be understood as limiting. It is also possible for more or fewer webs 11 to be present. The webs 11 may optionally be provided with a recess 12 and/or an opening in order to lower the weight of the stator 6. The webs 11 are arranged on the stator base body 9 so as to be distanced from one another in a circumferential direction 13.

Within the stator 6, the rotor 7 is arranged and/or at least partially arranged—as mentioned before, the representation of the coverings 8 (FIG. 1) was omitted. The rotor 7 has an (annular) rotor base body 14. On an external lateral surface 15 of said rotor base body 14, blades 16 are formed and/or arranged, which extend radially outwards starting from the lateral surface 15. In an assembled state of the camshaft adjuster 2, said blades 16 are arranged between the webs 11 of the stator 6. In this regard, side surfaces 17 of the webs 11 form the stop faces for the blades 16 of the rotor 7, as it is evident from FIG. 3.

The number of blades 16 of the rotor 7 is determined by the number of webs 11 of the stator 6, with the result that, in the specific case, thus four blades 16 are present.

The webs 11 define hydraulic working spaces 18. One working space 18 each is limited in the circumferential direction 13 by two webs 11. The blades 16, which are arranged between the webs 11, divide the working spaces 18 into a first working chamber 19 and a second working chamber 20, in each case by means of one blade 16 of the rotor 7. The relative position of the rotor 7 to the stator 6 can be changed by means of the fluid which can be introduced into said working chambers 19, 20, as it is known per se, so that regarding this, reference is made to the relevant prior art.

The rotor 7 is thus arranged within the stator 6 so as to be rotatable relative to the stator 6 in the circumferential direction 13, wherein the path of the rotatability is limited by the webs 11.

A control valve 23 (which may also be referred to as central valve) is arranged at least partially inside a recess 22 of the rotor 7, extending in an axial direction 21 and/or (passing) through the rotor 7, meaning so as to be at least partially surrounded by the rotor 7.

Figure 5:
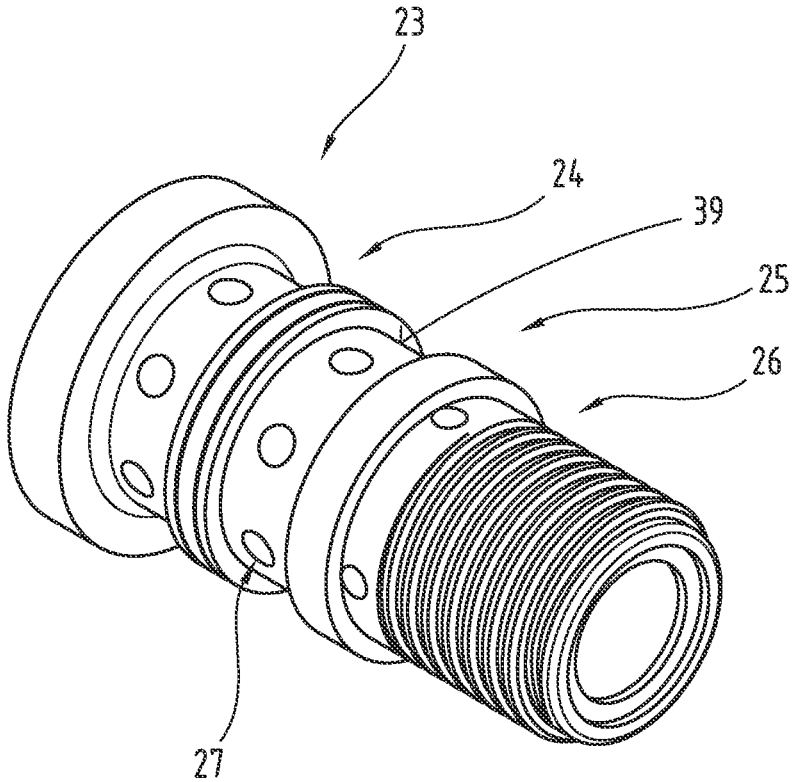
FIG. 5 show a control valve of a hydraulic camshaft adjuster.

FIG. 5 shows an embodiment variant of the control valve 23. Said control valve 23 has multiple conical or cylindrical sections 24 to 26 with openings 27 (bores), through which the hydraulic fluid can be fed into and/or discharged from the working chambers 19, 20, depending on the position of a piston 28. A circuit for the hydraulic fluid (in particular, an oil) is adumbrated with arrows 29 in FIG. 2.

The piston 28 may be actuated magnetically, for instance.

For the sake of completeness, it should be mentioned that the working spaces 18 and thus also the working chambers 19, 20 are limited radially inwards by a surface 30 (in particular, by its lateral surface 15) of the rotor base body 14 and radially outwards by a surface 31 (in particular, by its lateral surface 10) of the stator base body 9.

Furthermore, seals may be arranged on the blades 16, which seals seal a distance between the blades 16 and the surface 30 (in particular of its lateral surface 10) during operation of the hydraulic camshaft adjuster 1. These seals may be arranged partially inside the blades 16.

Feeding the hydraulic fluid to the working chambers 19, 20 can be carried out by means of a camshaft 32, which is arranged on the camshaft adjuster 1.

For conducting the hydraulic fluid, corresponding channels and/or lines may be provided and/or arranged in components of the camshaft adjuster 1 and/or the camshaft 32.

The rotor 7 is a single-piece component, preferably a sintered component, so that the blades 16 thus form a single, integral component, in particular a sintered component, with the rotor base body 14.

For further details on hydraulic camshaft adjusters 1, which are not related to the invention, reference is made to the relevant prior art.

Thus, the production of the rotor 7 is preferably carried out using a powder-metallurgical method. This method comprises the method steps:

- providing a first powder for producing the rotor 7 in a mold cavity of a mold;
- pressing the first powder to form a rotor green compact in the mold;
- possibly green machining the rotor green compact;
- sintering the rotor green compact;
- possibly post-processing the rotor green compact by means of material removal;

The stator 6 is also preferably a single-piece component, in particular a sintered component (meaning it was produced from a sintering material according to a powder-metallurgical method), so that the spur gearing 4 and the webs 11 thus form a single, integral component, in particular a sintered component with the base body 9.

This method comprises the method steps:

- providing a second powder for producing the stator 6 in a mold cavity of a mold;
- pressing the second powder to form a stator green compact in the mold;
- possibly green machining the stator green compact;
- sintering the stator green compact;
- possibly post-processing the stator 6 by means of material removal;
- possibly hardening the spur gearing 4 of the stator 6.

The green machining and/or the post-processing by means of material removal of the stator 6 and/or of the rotor 7 can be carried out for example by sanding, lapping, honing etc.

The hardening of the spur gearing 4 can be carried out for example by inductive hardening, quench hardening, case-hardening etc.

The sintering process of the stator 6 and/or the rotor 7 can be designed having one or multiple stages. Moreover, it can be carried out at a temperature between 700° C. and 1300° C. for a period of 10 minutes to 120 minutes, for instance.

As the powder-metallurgical production of sintered components is known per se from the prior art, reference is made to the relevant prior art in order to avoid repetitions in this regard.

It is substantial that at least one of the components of the camshaft adjuster 1 is produced in a powder-metallurgical manner and that this component is produced without a calibration step. In this regard, the stator 6 or the rotor 7 or the stator 6 and the rotor 7 may be produced, within the scope of the invention, in a powder-metallurgical manner.

In order to make the production of the sintered component of the camshaft adjuster 1 possible without a calibration step, it is provided within the scope of this invention that tolerances provided thus far in radially internal regions are reduced, and the tolerance gain achieved thereby is shifted to regions that are radially external in comparison with said radially internal regions, for example to the spur gearing 4, in order to be able to better allow for concentricity inaccuracies there, for instance. In this regard, the tolerance transfer can take place within a component or from one component to another component of the camshaft adjuster 1, for example from the rotor 7 to the stator 6 and/or from the control valve 23 to the stator 6. Although the following discloses specific examples for this, this paragraph represents the thought essential to the invention, and the invention is not limited to the fitting and/or sealing surfaces, specifically mentioned in the following, with respect to the clearance fit or the press fit.

To this end, it may be provided, for example, that a radially internal fitting surface pairing and/or generally surface pairing between components of the camshaft adjuster 1, hence in particular between the rotor 7 and the stator 6, or a surface pairing with the camshaft 32, a clearance fit with a maximum clearance of 100 μm, in particular with a maximum clearance of 80 μm, for example a clearance between 5 μm and 60 μm or between 5 μm and 50 μm, or a press fit be formed and/or be produced.

In this regard, a clearance fit is a fit in which a distance is present between the two surfaces involved in it. For a press fit, one of the two components is preferably produced having an excess at least in the region of the involved surfaces of the two components.

For example, such a fit can be formed between at least one fitting surface 33 of the stator 6 and an external lateral surface 34 of the camshaft 32, which is located opposite the fitting surface 33 of the stator 6 in an attached state, as it can be seen in FIG. 2. This fitting surface 33 of the stator 6 can be formed for example on a (rear) covering 35 of the stator, which covering 35 is possibly configured in a single piece with the stator base body 9, the spur gearing 4 and the webs 11, for example as an internal lateral surface of said covering 35 and/or generally of the stator 6.

Moreover, the rotor base body 14 may be formed having at least one fitting surface 36 for contacting the camshaft 32, and said fitting surface 36 may be formed according to the invention, so that the described fit is achieved with the lateral surface 34 of the camshaft 32. The fitting surface 36 of the rotor base body 14 may be formed on an internal lateral surface of the rotor base body 14, as it is also shown in FIG. 2.

According to a further embodiment variant of the camshaft adjuster 1, it may be provided that the rotor 7 has at least one fitting surface 37 in the recess 22 for the control valve 23, which fitting surface 37 forms the described fit with at least one sealing surface 38 of the control valve 23. The sealing surface 38 is formed on an external lateral surface 39 (shown in FIG. 5) of the control valve 23.

According to a further embodiment variant of the camshaft adjuster 1, it may be provided that the control valve 23 is formed having a correspondingly low tolerance (within the sense of the aforesaid) in the region of the sealing surface 38 itself.

It is also possible for multiple ones of these embodiment variants to be provided together in a hydraulic camshaft adjuster 1, for example the fit between the fitting surface 33 of the stator 6 and the lateral surface 34 of the camshaft 32 and/or the fit between the fitting surface 36 of the rotor 7 and the lateral surface 34 of the camshaft 32 and/or the fit between the fitting surface 37 of the rotor and the sealing surface 38 of the control valve 23 and/or the described low tolerance of the control valve 22 in the region of the sealing surface 38 itself.

The correspondingly low tolerances may be provided by providing components having a correspondingly higher accuracy in the region of the described surfaces.

In addition or alternatively to this, it may be provided that in the region of the described surfaces, in particular of the fitting surfaces 33, 36, 37 and/or the lateral surface 34 and/or the sealing surface 38, these components is/are produced having a coverage, at least in some regions, for forming a press fit.

The coverage can be selected, for example from a range between 0 μm and 80 μm, in particular from a range between 0.1 μm and 70 μm. In this regard, a coverage is an excess of the respective component with respect to the target dimensions. Should both components be produced having an excess, the aforementioned values of the coverage are to be considered the sum of both coverages.

In principle, one or both of the components of the camshaft adjuster 1 involved in the respective fit, can be formed with the corresponding excess of the entire regions of the surfaces involved. However, as it is preferred that the press fit is carried out by means of material plasticization during assembly of the camshaft adjuster 1, it can be advantageous for the assembly if the respective coverage is only formed in some regions on these surfaces. To this end, it may be provided that the press fit or the press fits is formed between the respective fitting surface 33, 36, 37 and at least one projection 40, protruding in a radial direction, of the further fitting surface 33, 36, 37 involved in the press fit, or sealing surface 38 and/or generally of the surfaces further involved in the press fit. For an illustration, reference is made to FIGS. 5 and 6.

The projection 40 or the projections 40 (hereinafter the at least one projection 40) extends/extend over at least a segment of the respective fitting surface 33, 36, 37, in particular in the axial direction 21 (see FIG. 1). The at least one projection 40 can extend over an area of between 30% and 90%, in particular between 50% and 80%, of the longitudinal extension of the fitting surface 33, 36, 37 in the axial direction 21. However, it is also possible that the at least one projection 40 extends over the entire length of the fitting surface 33, 36, 37, hence over 100%.

The at least one projection 40 may be produced with a maximum height 41, measured from the respective fitting surface 33, 36, 37, which height 41 is selected from a range between 0.005 mm and 3 mm, in particular from a range between 0.002 mm and 0.5 mm.

The at least one projection 40 can extend in the axial direction 21 starting from an end face. However, it is also possible for the at least one projection 40 to be formed so as to be distanced from the end face.

Figure 6:
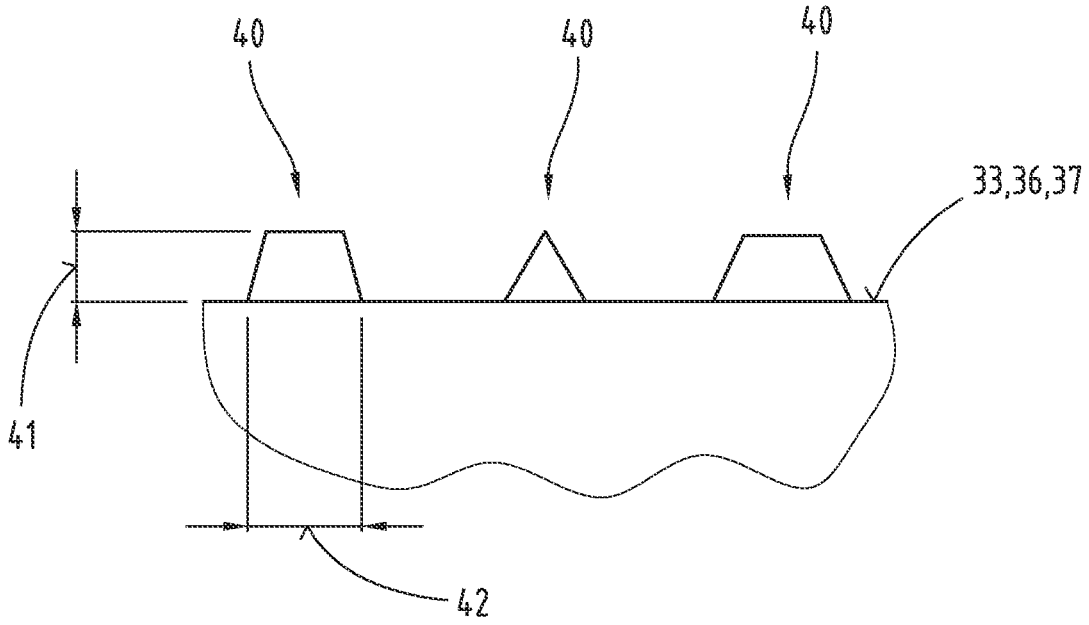
FIG. 6 shows a cutout from a fitting surface with embodiment variants of the projections in cross-section.
Figure 7:
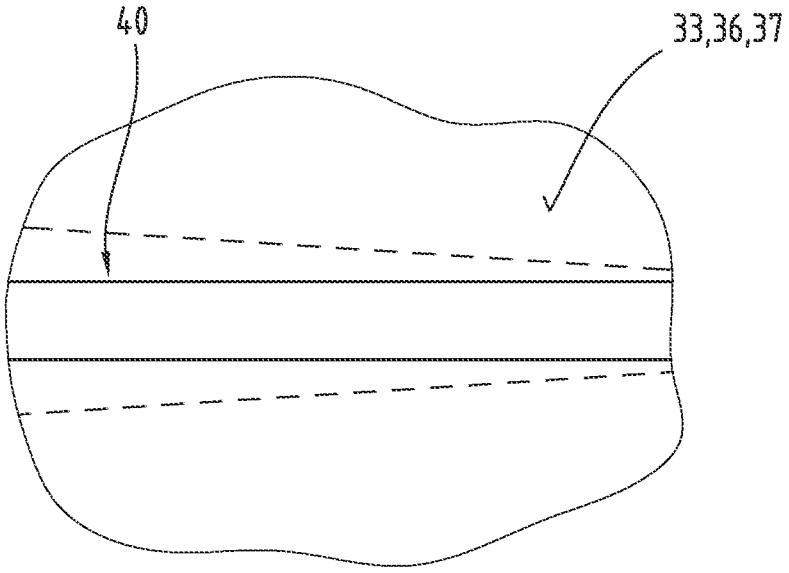
FIG. 7 shows a cutout from a fitting surface with a projection in a top view.

According to a preferred embodiment variant, the at least one projection 40 is formed to be at least approximately strip-shaped, so that it therefore has a significantly greater length than width, as is evident from the combination of FIG. 6 and FIG. 7. In general, a maximum width 42 of the at least one projection 40 can be selected from a range between 0.1 mm and 5 mm, in particular from a range between 0.3 mm and 2.5 mm.

According to embodiment variants, it is also possible that differently formed projections 40, for example projections of different sizes, are arranged and/or formed on the fitting surface 33, 36, 37 or on different fitting surfaces 33, 36, 37. For example, it is possible that the projections 40 of a fitting surface 33, 36, 37 are different from the projections 40 of a different fitting surface 33, 36, 37 with respect to their width 42 and/or with respect to their height 41.

Preferably, the at least one projection 40 can be plastically deformed. This can be achieved by the at least one projection 40 consisting of a softer material than the rest of the component, which has the at least one projection 40, and/or that the at least one projection 40 has cavities, for example pores, which are at least partially compressed during the plastic deformation. To this end, the at least one projection 40 can be produced from a sintering material. As explained above, however, the entire stator 6 or rotor 7 preferably consists of the material from which the at least one projection 40 is produced.

Merely for the sake of completeness, it should be noted that metallic powders are used as sintering powders.

The at least one projection 40 can have a consistent cross-section along its entire longitudinal extension in the direction of the axial direction 21. However, according to a further embodiment variant, it is also possible that the at least one projection 40 is formed to at least partially taper along the longitudinal extension, as it is adumbrated in dashed lines in FIG. 7, or are provided with a bevel. In particular, the at least one projection 40 can be formed having a cross-section that becomes wider in the clamping direction. This can serve to simplify the assembly of the camshaft adjuster 1.

For a better plastic deformability, the at least one projection 40 can have a (conically) tapering progression at least over a region of 20% to 100% of its longitudinal extension.

The at least one projection 40 can have a rectangular, a square etc. cross-section. According to an embodiment variant, the at least one projection 40 can, however, also have a triangular or trapezoidal cross-section, as it can be seen in FIG. 6, whereby its plastic deformability can be improved.

For the same reason, it may be provided according to a further embodiment variant that a transition region from the fitting surface 33, 36, 37 to the at least one projection 40 is slanted or rounded.

For an easier assembly of the camshaft adjuster 1 and/or in order to simplify the plastic deformation, it may be provided according to an embodiment variant that the at least one projection 40 is formed having a height increasing over the course of its longitudinal extension over the fitting surface 33, 36, 37. In this regard, the height of the at least one projection 40 decreases in the direction of the clamping direction. It should be noted that the clamping direction is the direction of the assembly of the components of the camshaft adjuster 1.

It is further possible that a longitudinal rill extending in the longitudinal direction of the at least one projection 40 is formed directly next to the at least one projection 40, whereby the plastic deformability of the at least one projection 40 can also be improved. It is possible for such one rill each to be arranged on either side of the at least one projection 40.

Preferably, the longitudinal extension of the at least one projection 40 is greater than its width 42, as per the explanation above. In this regard, it may be provided that the longitudinal extension of the at least one projection 40 is greater by a value that is selected from a range between 1:10 and 1:100 of the width.

Figure 8:
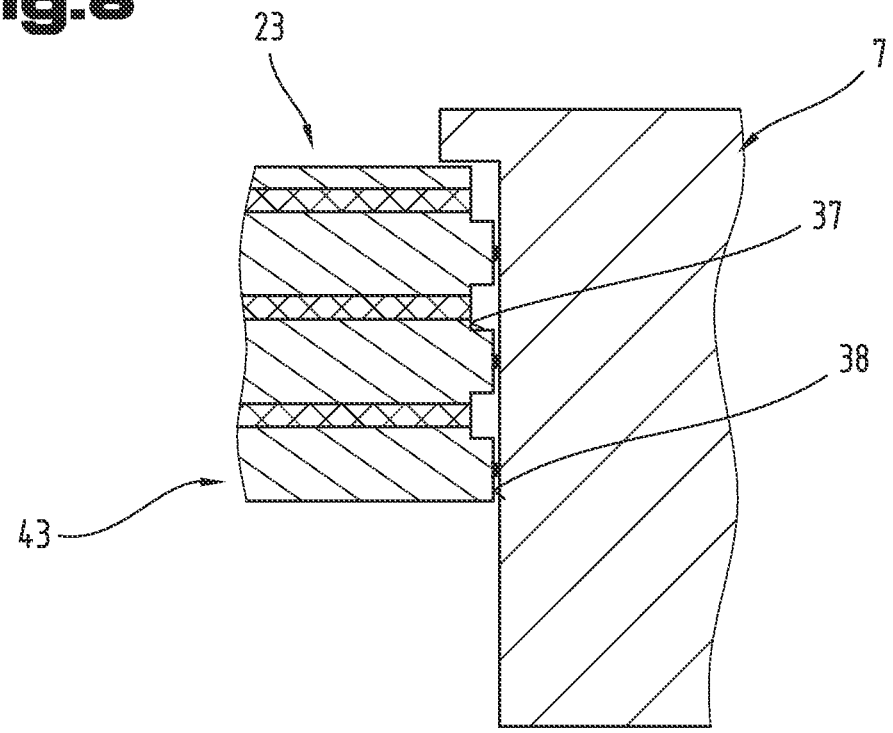
FIG. 8 shows a longitudinal section of an embodiment variant of the control valve.
Figure 9:
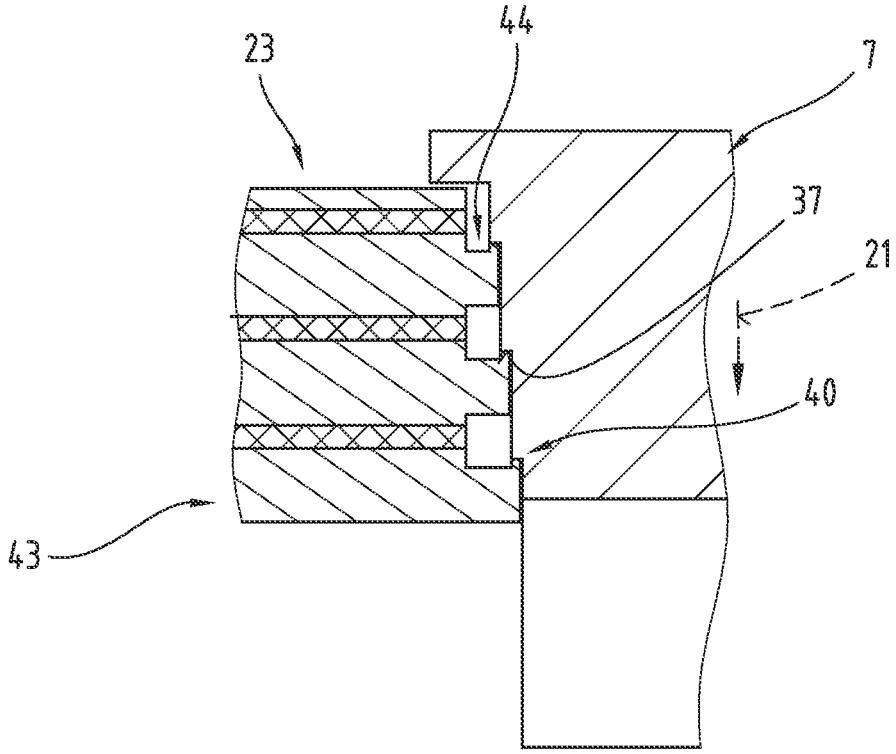
FIG. 9 shows a longitudinal section of another embodiment variant of the control valve.

According to a further embodiment variant, it may be provided that the projection 40 has an annular design. This embodiment variant is preferably used for the control valve 23, namely on its sealing surface 38, as FIGS. 8 and 9 show. From these figures, it is also evident that the control valve 23 can have multiple sealing surfaces 38. In the embodiment variants shown, the control valve 23 has three sealing surfaces 38, which are arranged on annular webs 43.

However, the annular design of the at least one projection 40 can also be provided on the corresponding fitting surfaces 33, 36 of the stator 6 and/or rotor 7.

The embodiment variants of the control valve 23 according to FIGS. 7 and 8 differ only in that the at least one projection 40 is arranged and/or formed to protrude beyond the sealing surface 38 in the radial direction in the case of the embodiment variant according to FIG. 8 and in the axial direction 21 in the case of the embodiment variant according to FIG. 9. Accordingly, also in the case of the rotor 7, the fitting surface 37 is a lateral surface of the control valve 23 in FIG. 8 and an end face of the control valve 23 in FIG. 9.

It is also possible to combine both embodiment variants of the arrangement of the at least one projection 40 (protruding radially and axially) in one embodiment variant of the control valve 23.

In the embodiment variant of the control valve 23 according to FIG. 9, an undercut 44 is formed with the at least one projection. In order to form the at least one undercut 44, it may be provided that when producing the at least one projection 40 on the control valve 23, it is formed so as to protrude beyond the sealing surface 38 in the axial direction 21 and/or in the radial direction, and at least in the embodiment variant, in which the projection 40 protrudes beyond the sealing surface 38 only in the axial direction 21, said projection 40 is pressed at least so much in the axial direction 21 that the undercut 44 is formed. To this end, the projection 40 is first produced so as to protrude in the radial direction at the transition and/or in the region of the transition from the lateral surface to the end face of the control valve 23, and is subsequently "folded down" onto the end face by means of the pressing operation and the plastic deformation occurring because of it.

In this regard, the pressing operation can be carried out during the installation of the control valve 23 in the rotor 7 via the fitting surface 37 of the rotor 7 cooperating with the sealing surface 38.

It should be mentioned that explanations regarding the at least one strip-shaped projection 40 are also at least partially applicable to the at least one annular projection 40.

According to an embodiment variant, it can be further provided that the at least one projection 40 on the sealing surface 38 of the control valve 23 consists of and/or is made of a sintering material. The rest of the control valve body, however, may be formed as a cast part. The at least one projection 40 can, for example, be sintered onto a cast control valve.

As is evident from FIG. 5, the control valve 23 can have an external thread. It is thus possible that the rotor 7 and, with that, indirectly also the stator 6 of the camshaft adjuster 1 with the control valve 23 is screwed onto the camshaft 32.

The control valve 23 does not necessarily have to be arranged in the recess 22 of the rotor 7. It can also be placed at a different location, so long as the hydraulic fluid can reach the working chambers 19, 20 via corresponding lines.

According to a further embodiment variant of the invention, it may be provided that in the front-end region facing the camshaft 32, the control valve 23 is produced or formed having a diameter 45 that is slightly greater than a diameter 46 of the fitting surfaces 37 on the internal lateral surface 47 (see FIG. 3) of the rotor 7. Thus, the at least one fitting surface 37 is plastically deformed upon insertion of the control valve 23 into the recess 22 of the rotor 7. This, in turn, allows a clearance to form between the rotor 7 and control valve 23, whereby the rotor 7 can be rotated relative to the control valve 23 more easily.

The term "slightly" particularly means that the diameter 45 of the control valve 23 is greater by 0.1 μm to 20 μm, in particular by 0.5 μm to 10 μm than the diameter 46 of the fitting surfaces 37.

The front region of the control valve 23 is that region which dips in front of the at least one sealing surface 38 upon the insertion of the control valve 23 into the recess 22 of the rotor 7, and is thus formed in front of the at least one sealing surface 38 in the axial direction 21.

The exemplary embodiments show possible embodiment variants, while it should be noted at this point that combinations of the individual embodiment variants are also possible.

Moreover, a stator 6 may also be an independent invention if it is provided that it is a single-piece component made of a sintering material, comprising the stator base body 9, which has the external spur gearing 5, the radially internal lateral surface 10 and webs 11 protruding radially inwards from the radially internal lateral surface 10, which webs 11 are distanced from one another in the circumferential direction 13 of the stator base body 9; and which has a tolerance in the region of the fitting surface 33 of the stator base body 9 for contacting the camshaft 32, that a clearance fit with a maximum clearance of 100 μm, in particular with a maximum clearance of 80 μm, for example a clearance between 5 μm and 60 μm or between 5 μm and 50 μm, or a press fit is formed between the fitting surface 33 for the camshaft 32 and the camshaft 32. In this regard, reference is made to the corresponding explanations regarding the stator 6.

However, within the scope of the invention, the stator 6 is in general preferably not formed with a press fit to the camshaft 32 but having a clearance fit to the camshaft 32.

Further, the rotor 7 may be an independent invention if it is provided that it is a single-piece sintered component, comprising a rotor base body 14, which has blades 16 protruding radially outwards from a radially external lateral surface 15, and which has a tolerance in the region of the fitting surface 36 of the rotor base body 14 for contacting the camshaft 32 and/or in the region of the fitting surface 37 for contacting the sealing surface 38 of the control valve 23, that a clearance fit with a maximum clearance of 100 μm, in particular with a maximum clearance of 80 μm, for example a clearance between 5 μm and 60 μm or between 5 μm and 50 μm, or a press fit is formed between the fitting surface 36 for the camshaft 32 and the camshaft 32 and/or between the fitting surface 37 for contacting the sealing surface 38 of the control valve 23. In this regard, reference is made to the corresponding explanations regarding the rotor 6.

In addition, the control valve 23 may be an independent invention if it is provided that it is produced on an external lateral surface having a sealing surface 38, and which has a tolerance in the region of the sealing surface 38, that a clearance fit with a maximum clearance of 100 μm, in particular with a maximum clearance of 80 μm, for example a clearance between 5 μm and 60 μm or between 5 μm and 50 μm, or a press fit is formed between the fitting surface 37 of the rotor 7 for contacting the sealing surface 38 of the control valve 23 and said sealing surface 38 of the control valve 23. In this regard, reference is made to the corresponding explanations regarding control valve 23.

Finally, as a matter of form, it should be noted that for ease of understanding of the structure of the hydraulic camshaft adjuster 1 and/or elements thereof are not necessarily depicted to scale.

Although only a few embodiments of the present invention have been shown and described, it is to be understood that many changes and modifications may be made thereunto without departing from the spirit and scope of the invention.

What is claimed is:

1. A method without a calibration step for producing a hydraulic camshaft adjuster, comprising a stator with a stator base body, which is produced with an external spur gearing, a radially internal lateral surface and with webs protruding radially inwards from the radially internal lateral surface, wherein the webs are distanced from one another in a circumferential direction of the stator base body, and wherein the stator base body is produced with a stator base body radial fitting surface for contacting a camshaft;

a rotor being rotatable relative to the stator and having a rotor base body, which is at least partially surrounded by the stator and which is produced with blades protruding radially outwards from a radially external lateral surface, so that multiple hydraulic working spaces are formed between the stator and the rotor, each of which working spaces being subdivided into a first working chamber and a second working chamber by a blade of the rotor; and a control valve which is arranged so as to be at least partially surrounded by the rotor;

wherein the control valve is produced with a sealing surface on an external lateral surface;

wherein the rotor base body is further produced having a recess for the control valve, and the recess is produced having a fitting surface for the sealing surface;

wherein the rotor base body is further produced having a rotor base body radial fitting surface for contacting the camshaft; and wherein at least one of the rotor and the stator is produced according to a powder-metallurgical process, comprising the method steps of:

providing a first powder for producing the rotor;

pressing the first powder to form a rotor green compact;

sintering the rotor green compact;

and/or comprising the method steps:

providing a second powder for producing the stator;

pressing the second powder to form a stator green compact;

sintering the stator green compact;

wherein the stator in the region of the stator base body radial fitting surface of the stator base body for contacting the camshaft and/or the rotor in the region of the rotor base body radial fitting surface of the rotor base body for contacting the camshaft and/or in the region of the fitting surface for contacting the sealing surface of the control valve and/or the control valve in the region of the sealing surface is or are produced with a tolerance, so that a clearance fit with a maximum clearance of 100 μm or a press fit is formed between a first surface comprising the stator base body fitting surface for the camshaft and a second surface comprising an external lateral surface of the camshaft and/or between a first surface comprising the rotor base body fitting surface for the camshaft and a second surface comprising an external lateral surface of the camshaft;

wherein for forming the press fit, at least one of the first and second surfaces is produced having an excess in the region of the press fit between the first and second surfaces.

2. The method according to a claim 1, wherein for forming the press fit or press fits on at least one of the fitting surfaces and/or the sealing surface, at least one projection protruding in the radial direction and/or the axial direction is formed, wherein the at least one projection is pressed, for forming the press fit, with the respective other surface of the surfaces forming the press fit.

3. The method according to claim 2, wherein the at least one projection is strip-shaped or annular.

4. The method according to claim 2, wherein the at least one projection has a trapezoidal or triangular cross-section.

5. The method according to claim 2, wherein the at least one projection has a height increasing over the course of the longitudinal extension.

6. The method according to claim 2, wherein the at least one projection has a maximum height which is selected from a range between 0.1 mm and 3 mm.

7. The method according to claim 2, wherein the at least one projection on the sealing surface of the control valve is produced in a powder-metallurgical manner.

* * * * *